United States Patent [19]

Bosnak

[11] Patent Number: 4,668,938

[45] Date of Patent: May 26, 1987

[54] SWITCHING AMPLIFIER AND ELECTRONIC SIREN EMPLOYING THE SAME

[75] Inventor: John J. Bosnak, Old Saybrook, Conn.

[73] Assignee: Whelen Engineering Company, Inc., Deep River, Conn.

[21] Appl. No.: 418,439

[22] Filed: Sep. 15, 1982

[51] Int. Cl.[4] ..... G08B 3/00

[52] U.S. Cl. ..... 340/384 E; 340/405

[58] Field of Search ..... 340/384 E, 384 R, 405; 307/315, 551, 550, 549; 331/47

[56] References Cited

U.S. PATENT DOCUMENTS

| | | | |
|---|---|---|---|
| 4,180,809 | 12/1979 | Feldstein | 340/384 R |
| 4,189,718 | 2/1980 | Carson et al. | 340/384 E |
| 4,237,448 | 12/1980 | Weinberg | 340/384 E X |
| 4,238,787 | 12/1980 | Pearlman et al. | 340/384 E |

OTHER PUBLICATIONS

"Radio Electronics", by Samuel Seely, McGraw-Hill, Copyright 1956, pp. 119–120.

"Electronic Devices and Circuit Theory", by Boylestad and Nashelsky, Prentice-Hall, second edition, Copyright 1978, pp. 337–338.

*Primary Examiner*—John W. Caldwell, Sr.

*Assistant Examiner*—Tyrone Queen

*Attorney, Agent, or Firm*—Chilton, Alix & Van Kirk

[57] ABSTRACT

A signal having a rectangular waveform, typically in the audio frequency range, is capacitively coupled to a pair of Darlington circuits which are connected in a push-pull arrangement across the primary winding of a power transformer. A clamping circuit insures that the breakdown voltage of the base-emitter junction of the input transistors of the Darlington circuits will not be exceeded during coupling capacitor discharge.

4 Claims, 1 Drawing Figure

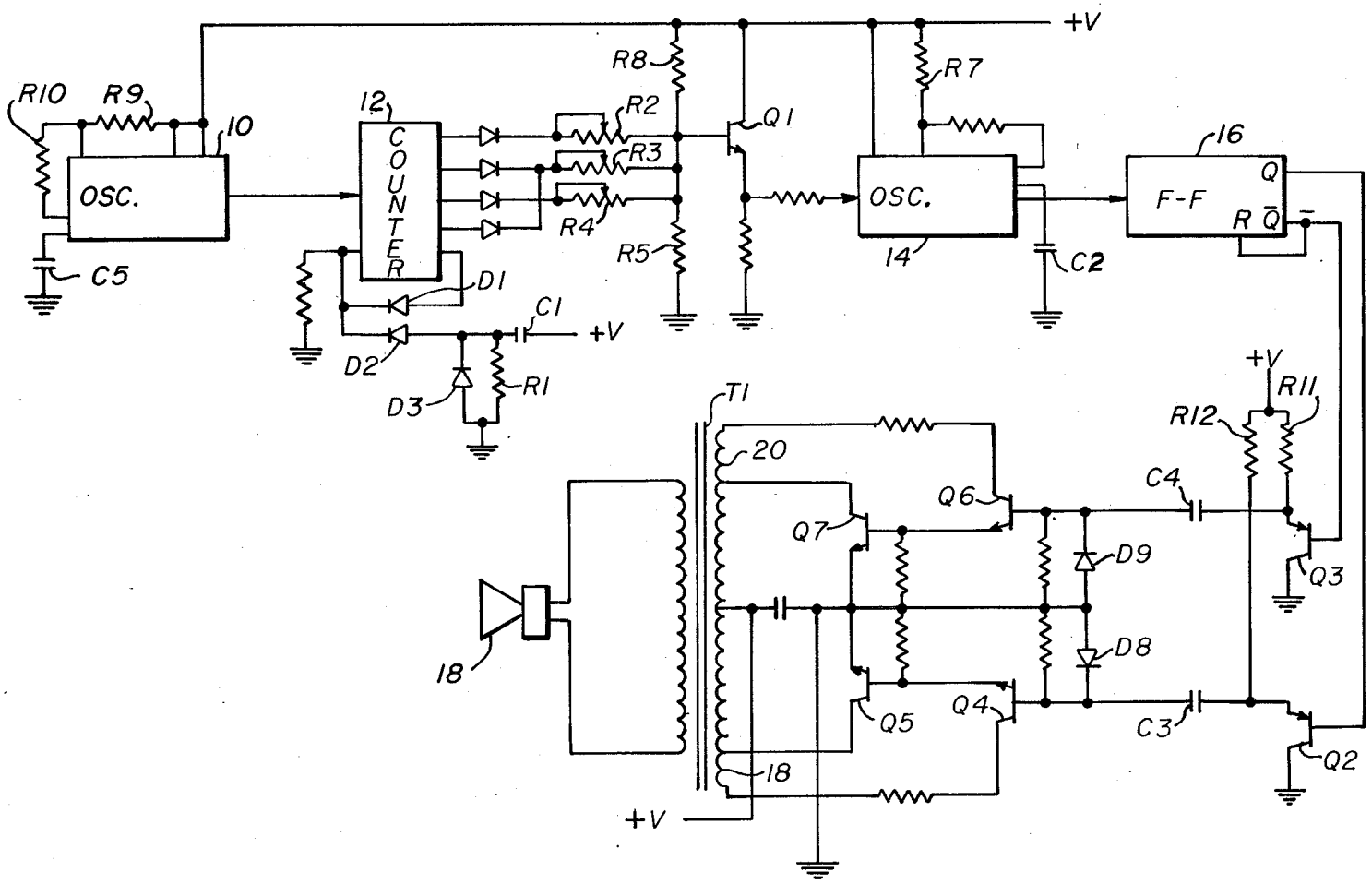
F-F
Q
R
Q̄
16
OSC.
14
C2
R7
+V
Q1
R8
R2
R3
R4
R5
COUNTER
12
D1
D2
D3
C1
R1
OSC.
10
R9
R10
C5
R11
R12
Q3
Q2
C4
C3
D9
D8
Q6
Q4
Q5
Q7
T1
20
18
18
+V

SWITCHING AMPLIFIER AND ELECTRONIC SIREN EMPLOYING THE SAME

BACKGROUND OF THE INVENTION (1) Field of the Invention

The present invention relates to switching amplifiers and particularly to such amplifiers for use in the generation of audible warning signals. More specifically, the present invention is directed to a reduction in the size and cost of means for amplifying signals having a rectangular wave form and especially to the provision of a compact electronic siren having high reliability. Accordingly, the general objects of the present invention are to provide novel and improved apparatus and methods of such character.

(2) Description of the Prior Art

While not limited thereto in its utility, the present invention is particularly well-suited for use in the generation of audible warning signals. Electronic sirens are, of course, well-known in the art. The typical prior art electronic siren, for example the apparatus disclosed in my U.S. Pat. No. 4,363,028 issued Dec. 7, 1982, is a comparatively sophisticated device capable of multi-mode operation. Thus, the electronic siren may selectively be operated as a audible warning signal generator, a public address system or a radio repeat device. Further, in the warning signal generation mode the prior art devices could typically be caused to selectively produce sounds having differing characteristics such as, for example, a "wail", a "yelp", a multiple tone or an air horn simulation. This multi-mode capability has necessarily required that a user having less demanding requirements pay penalties from the viewpoint of equipment cost and size.

There has been a long-standing demand for an electronic siren characterized by moderate cost and comparatively small size, so as to facilitate installation in so-called compact vehicles, which was at least comparable to the prior art devices in reliability and power handling capability. This long-standing demand has not been met at least in part because of the unavailability of a suitable circuit for amplifying the rectangular waveform audio frequency signals which will cause production of the desired sound when applied to a loudspeaker. Specifically, prior art power amplifiers of comparatively small size and moderate cost were not capable of reliably operating in a switching mode in response to a retangular waveform provided by oscillator means which may be controllable.

SUMMARY OF THE INVENTION

The present invention overcomes the above-briefly discussed and other disadvantages of the prior art by providing a novel and improved switching amplifier and an electronic siren which includes that amplifier. A siren in accordance with the present invention comprises means for producing a square wave signal in the audio frequency range. This signal is capacitively coupled to a power amplifier which comprises, in a preferred embodiment, a pair of Darlington circuits connected in a push-pull arrangement across the primary winding of an output transformer. The power amplifier comprising the Darlington circuits is provided with means for preventing the coupling capacitors from discharging during negative excursions of the square wave input signal, i.e., the power amplifier includes a clamping circuit.

BRIEF DESCRIPTION OF THE DRAWING

The present invention may be better understood and its numerous objects and advantages will become apparent to those skilled in the art by reference to the accompanying drawing which comprises a schematic diagram of an electronic siren in accordance with one embodiment of the invention, the siren including a switching amplifier in accordance with the preferred embodiment of the invention.

DESCRIPTION OF THE DISCLOSED EMBODIMENT

With reference to the drawing, an electronic siren of the type which produces three output tones in a predetermined sequence is disclosed. The siren shown in the drawing is of the type employed on emergency vehicles in Europe. It is to be understood, however, that it is within the contemplation of the present invention to produce the more familiar "wail" tone, alternately or selectively "wail" and "yelp" tones and/or a tone which simulates an airhorn and/or sounds having various other characteristics.

A common feature of electronic sirens in accordance with the present invention is the provision of a basic oscillator such as indicated at 10. Oscillator 10, in one reduction to practice, comprised a type 555 monolithic timing circuit (hereinafter the "timer"), available from IntersoL, Inc., with passive circuit components, i.e., resistors R9 and R10 and capacitor C5, connected to the timer to determine the output frequency thereof.

Timer 10 provides a pulse train which is delivered as the input to a counter 12 which may, for example, be a Signetics type 4017 five-stage Johnson counter. Counter 12 is connected such that it will provide single output pulses in sequence at five output terminals. The counter will be automatically reset by a signal coupled to its reset terminal from the fifth output terminal via diode D1. A circuit comprising capacitor C1, resistor R1 and diode D2 comprises a power-on reset such that counter 12 will be reset each time power is applied to the circuit. Diode D3 provides a discharge path for capacitor C1 when power is removed from the circuit.

Each of the first four output terminals of counter 12 is coupled via an associated isolation diode to the first end terminal and the wiper arm of one of variable resistors R2, R3 and R4, the variable resistors comprising a output frequency selection circuit. The second end terminals of these three variable resistors are connected together and to the base of transistor Q1. The base of transistor Q1 is also connected to ground via resistor R5 and to the supply voltage via resistor R8. The wiper arms of variable resistors R2, R3 and R4 are respectively set to provide, when a signal appears at the associated output terminal of counter 12, a voltage at the base of transistor Q1 having a magnitude commensurate with the desired output frequency. In the disclosed embodiment, as the "count" proceeds from the uppermost toward the lowermost of the counter output terminals, the siren will produce, in the manner to be more fully described below, a first tone followed by a second tone which is followed by a third tone which is followed by the second tone and the cycle then repeats.

Transistor Q1 is a buffer which is connected as an emitter follower for the purpose of reducing input loading on the variable resistors. Buffer Q1 provides a voltage at the control input to a second type 555 timer 14. Timer 14 is connected as a voltage controlled oscillator with its mean frequency being determined by the values of capacitor C2 and resistor R7. Timer 14 generates output pulses at a frequency which varies about this mean frequency as a function of the magnitude of the input signal thereto, i.e., as a function of the magnitude of the voltage appearing at the base of buffer Q1.

The pulse trains provided by timer 14 are delivered as the input to a flip-flop circuit 16 which, in a preferred embodiment, comprises one-half of a type 4013 COS/-MOS dual "D"-type device. Flip-flop 16 provides, at its Q and $\overline{Q}$ output terminals, low power, out-of-phase symmetrical square wave signals at a frequency which is one half the instantaneous output frequency of timer 14. A C/MOS flip-flop is employed in the interest of minimizing power consumption.

The square wave signals appearing at the Q and $\overline{Q}$ output terminals of flip-flop 16 are respectively applied to the bases of transistors Q2 and Q3. Transistors Q2 and Q3 function as buffers which increase the drive capability of the flip-flop 16. The collectors of transistors Q2 and Q3 are grounded while the emitters are coupled, via respective of resistors R11 and R12, to the supply voltage source. Transistors Q2 and Q3 are thus emitter followers which are alternatively rendered conductive by the output of flip-flop 16. The signals appearing at the emitters of transistors Q2 and Q3 are coupled, via respective of capacitors C3 and C4, to the base of an input transistor of a Darlington pair. The first of these Darlington amplifiers is comprised of transistors Q4 and Q5 while the second Darlington is comprised of transistors Q6 and Q7. The Darlington circuits are connected in a push-pull arrangement across the primary winding of output transformer T1.

In order to insure that the output transistors Q5 and Q7 of the Darlington circuits will be driven into saturation during operation, transformer T1 is provided with a pair of windings 18 and 20 in which bias voltages are induced. These bias voltages are, in the manner known in the art, fed back to the collectors of respective of Darlington circuit input transistors Q4 and Q6. The secondary winding of transformer T1 is, in the conventional manner, connected to the voice coil of a loudspeaker 18.

If there is a circuit failure which results in flip-flop 16 remaining in one state, direct coupling between the pulse source and the power amplifier would result in one of the Darlington circuits conducting continuously and the resulting current flow would result in overheating and damage to the output transistor of the conducting Darlington amplifier and possibly also to transformer T1. The capacitive coupling of transistors Q2 and Q3 to the Darlington circuits thus constitutes a safety feature since steady state signals appearing at the emitters of transistors Q2 and Q3 will not cause conduction of the input transistors of the Darlington circuits. Additional safety is provided by diodes D8 and D9 which clamp negative excursions of the base voltage of transistors Q4 and Q6 to approximately 0.7 volts. Diodes D8 and D9 are oppositely poled with respect to the base-emitter junction of the Darlington circuit drive transistors and insure that the breakdown voltage of the junctions will not be exceeded.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

I claim:

1. An electronic siren comprising:

oscillator means, said oscillator means providing a pair of 180° out-of-phase symmetrical square wave signals in the audio frequency range;

a first Darlington circuit, said first Darlington circuit having a drive stage and an output stage, each of said stages comprising a transistor amplifier, the input terminal for said drive stage being directly connected to the base of its transistor amplifier;

a second Darlington circuit, said second Darlington circuit having a drive stage and an output stage, each of said stages of said second Darlington circuit comprising a transistor amplifier, the input terminal for said drive stage of said second Darlington circuit being directly connected to the base of its transistor amplifier;

an output transformer having a primary winding and a secondary winding, the output transformer also having a pair of further windings, bias voltages being induced in said further windings in response to current flow through said primary winding;

a loudspeaker connected to said transformer secondary winding;

means connecting said first and second Darlington circuits in a push-pull configuration whereby first terminals of the transistor amplifiers comprising the output stages of said Darlington circuits are connected to oppositely disposed points on said output transformer primary winding;

first and second coupling means for coupling said square wave signals provided by said oscillator means to said Darlington circuits, a first of said coupling means coupling a first of said square wave signals of said pair of square wave signals to the drive stage input terminal of the first of said Darlington circuits and the second of said coupling means coupling the second of said square wave signals of said pair of square wave signals to the drive stage input terminal of the second of said Darlington circuits and first and second coupling means each comprising:

a coupling capacitor connected between said oscillator means and the drive stage input terminal of the associated Darlington circuit, and clamp means for limiting the voltage applied to the Darlington circuit drive stage input terminal during discharging of said coupling capacitor, said clamp means comprising a diode having a first terminal connected to said input terminal, said diode being connected in opposite polarity to the diode defined by the base-emitter junction of the said associated Darlington circuit drive stage transistor amplifier;

means for applying the bias voltages induced in respective of said output transformer further windings to respective of said Darlington circuit drive stage transistor amplifiers whereby said Darlington circuits will alternately be driven into saturation during operation; and means directly connecting the second terminal of the said diode of each of said clamp means to a common point of said means connecting said Darlington circuits in a push-pull configuration.

2. The siren of claim 1 wherein said oscillator means comprises:

means for generating an unsymmetrical pulse train at a desired frequency; and multivibrator means for converting said unsymmetrical pulse train into said pair of square wave signals, said multivibrator means being a C/MOS circuit.

3. The siren of claim 2 wherein said coupling means each further comprises:

buffer amplifier means connected between said multivibrator means and a coupling capacitor for increasing the Darlington circuit drive current.

4. The siren of claim 3 wherein said buffer amplifier means comprises a transistor connected as an emitter follower, the collectors of said emitter followers being connected to said common point.

* * * * *